US006160541A

United States Patent [19]

Palalau et al.

[11] Patent Number: 6,160,541

[45] Date of Patent: Dec. 12, 2000

[54] POWER CONSUMPTION CONTROL FOR A VISUAL SCREEN DISPLAY BY UTILIZING A TOTAL NUMBER OF PIXELS TO BE ENERGIZED IN THE IMAGE TO DETERMINE AN ORDER OF PIXEL ENERGIZATION IN A MANNER THAT CONSERVES POWER

[75] Inventors: Silviu Palalau, Birmingham; Daniel Toffolo, Dearborn, both of Mich.

[73] Assignee: Lear Automotive Dearborn Inc., Southfield, Mich.

[21] Appl. No.: 08/784,616

[22] Filed: Jan. 21, 1997

[51] Int. Cl.[7] ..... G09G 5/00; G09G 5/10

[52] U.S. Cl. ..... 345/211; 345/147

[58] Field of Search ..... 345/76, 78, 79, 345/58, 99, 100, 147, 149, 77, 107, 63, 96, 87, 209, 204, 211, 98, 2, 10, 127, 428, 133, 212; 349/49

[56] References Cited

U.S. PATENT DOCUMENTS

| | | | |
|---|---|---|---|
| Re. 33,532 | 2/1991 | Ishii | 345/148 |
| 3,765,011 | 10/1973 | Sawyer et al. | 345/147 |
| 4,462,044 | 7/1984 | Thomason et al. | 348/44 |
| 4,642,524 | 2/1987 | Eaton et al. | 315/169.3 |
| 4,837,566 | 6/1989 | Channing et al. | 345/76 |
| 4,864,290 | 9/1989 | Waters | 345/89 |
| 5,254,981 | 10/1993 | Disanto et al. | 345/107 |
| 5,293,159 | 3/1994 | Bassetti, Jr. et al. | 345/149 |
| 5,315,311 | 5/1994 | Honkala . | |
| 5,329,288 | 7/1994 | Kim | 345/63 |
| 5,451,979 | 9/1995 | Levac | 345/212 |
| 5,745,085 | 4/1998 | Tomio et al. | 345/77 |
| 5,796,391 | 8/1998 | Chiu et al. | 345/204 |
| 5,822,599 | 10/1998 | Kidder et al. | 345/212 |
| 5,828,367 | 10/1998 | Kuga | 345/211 |
| 5,831,588 | 11/1998 | Hotto | 345/100 |
| 5,852,426 | 12/1998 | Erhart et al. | 349/96 |
| 5,867,140 | 2/1999 | Rader | 345/100 |
| 5,886,689 | 3/1999 | Chee et al. | 345/212 |
| 5,926,173 | 7/1999 | Moon | 345/211 |
| 5,973,456 | 10/1999 | Osada et al. | 315/169.1 |
| 5,986,640 | 11/1999 | Baldwin et al. | 345/147 |

FOREIGN PATENT DOCUMENTS

| | | |
|---|---|---|
| 0698874A1 | 2/1996 | European Pat. Off. . |
| WO9012388 | 10/1990 | WIPO . |
| WO9313513 | 7/1993 | WIPO . |

OTHER PUBLICATIONS

International Search Report on International Application No. PCT/US98/00267 with a filing date of Jan. 8, 1998.

*Primary Examiner*—Steven J. Saras
*Assistant Examiner*—Paul A. Bell
*Attorney, Agent, or Firm*—Niro, Scavone, Haller & Niro

[57] ABSTRACT

A method of controlling the brightness levels on a screen includes determining a total number of screen pixels that must be energized to realize various brightness levels throughout the display. The display preferably is generated in a sequence of frames that are subdivided into energization states. An electronic controller determines an order of energizing selected ones of the pixels during each of the energization states to realize the desired brightness levels for the display while reducing drive load variation and realizing more efficient power consumption.

19 Claims, 4 Drawing Sheets

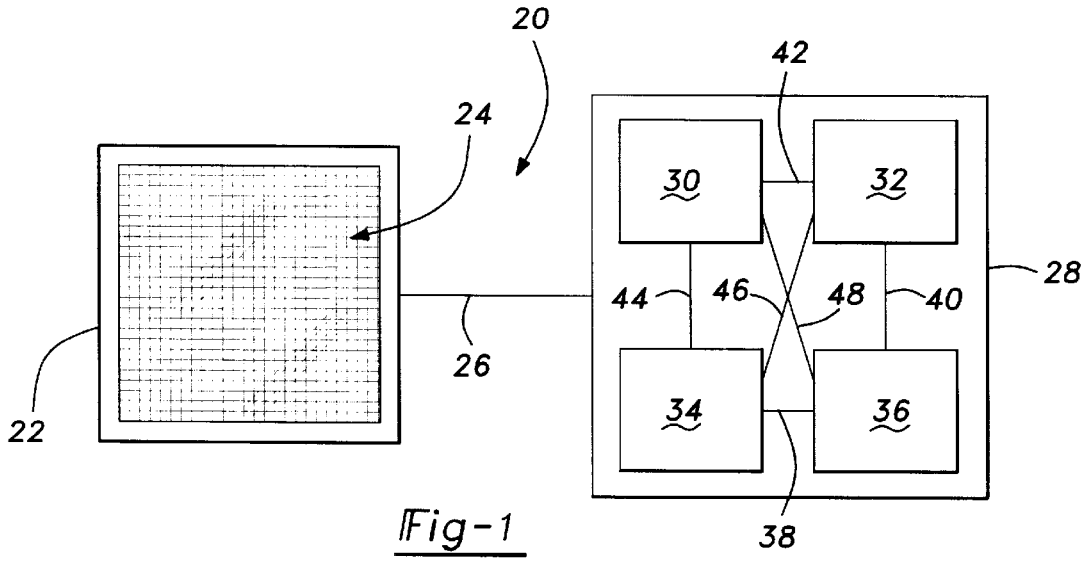
Fig-1
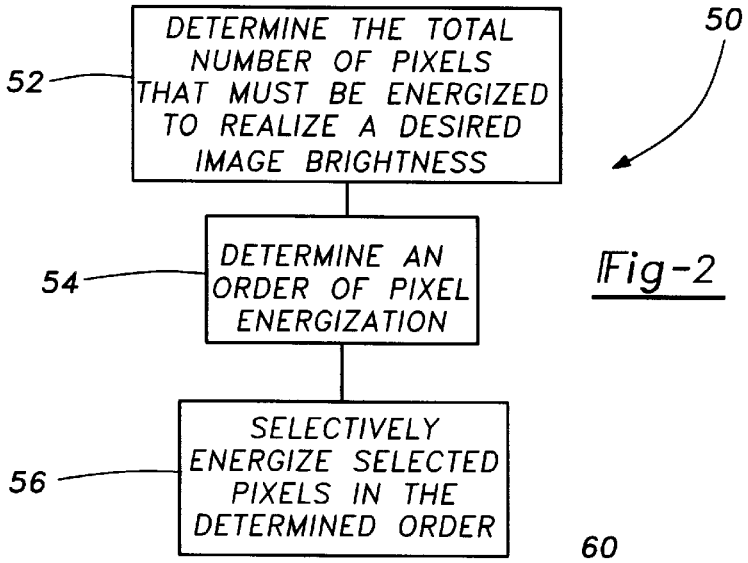
Fig-2
60
62 63 70 78
| Shade | Case 1 | Case 2 | Case 3 | Case 4 | Case 5 | Case 6 | Case 7 | Case 8 | Case 9 |
|---|---|---|---|---|---|---|---|---|---|
| Dark | 000 | 000 | 000 | 000 | 000 | 000 | 000 | 000 | 000 |
| Low | 100 | 010 | 001 | 100 | 010 | 001 | 100 | 010 | 001 |
| Med | 110 | 110 | 110 | 101 | 101 | 101 | 011 | 011 | 011 |
| High | 111 | 111 | 111 | 111 | 111 | 111 | 111 | 111 | 111 |
64 66 68 72 74 76 80 82 84
Fig-3

POWER CONSUMPTION CONTROL FOR A VISUAL SCREEN DISPLAY BY UTILIZING A TOTAL NUMBER OF PIXELS TO BE ENERGIZED IN THE IMAGE TO DETERMINE AN ORDER OF PIXEL ENERGIZATION IN A MANNER THAT CONSERVES POWER

BACKGROUND OF THE INVENTION

This invention generally relates to controlling a visual screen display to reduce the amount of power consumed when displaying an image. More particularly, this invention relates to a method of selectively energizing screen pixels to realize a desired screen brightness while saving power and reducing variations in the amount of energy used to power the display screen.

A variety of visual screen displays are useful for displaying electrically generated images. A variety of factors must be accounted for to produce a desirable display. One of those factors is the brightness or shading level on the screen. One way of controlling screen shading is known as frame modulation.

Frame modulation techniques have several advantages, however, they do not always optimize power consumption. More recently, visual displays have been used with portable devices, which necessarily are powered by a battery or a similar portable energy source. In such situations it is especially important to control power consumption by a display screen to maximize battery life. Conventional frame modulation techniques typically included a static method of sequencing for energizing screen pixels to realize various brightness levels on the screen. Such static sequencing techniques do not efficiently utilize limited battery power. Therefore, there is a need for more efficient control of power consumption in a screen display, especially where frame modulation techniques are used to realize varying brightness levels.

SUMMARY OF THE INVENTION

This invention is a system and method for saving power and reducing drive load variation when powering a screen display that includes varying brightness levels. In general terms, the method of this invention includes several basic steps. First, a total number of screen pixels that must be energized to realize an electrically generated image across a screen is determined on a row-by-row basis. A specific order of energizing selected ones of the screen pixels is determined, based upon the total number of screen pixels that must be energized. Then the total number of screen pixels are energized selectively in the specific order that has been determined.

In the preferred embodiment, a frame modulation technique is used that includes displaying the image in a sequence of frames that are each divided into a plurality of energization periods. An order of energization is determined by arranging the total number of rows of pixels to be energized among the energization periods.

Various features and advantages of this invention will become apparent to those skilled in the art from the following detailed description of the presently preferred embodiment. The drawings that accompany the description can be described as follows.

BRIEF DESCRIPTION OF THE DRAWINGS

FIG. 1 is a schematic illustration of a system designed according to this invention.

FIG. 2 is a flow chart diagram illustrating a method of this invention.

FIG. 3 schematically illustrates possible implementations of a method of this invention.

DETAILED DESCRIPTION OF THE PREFERRED EMBODIMENT

Figure 4:
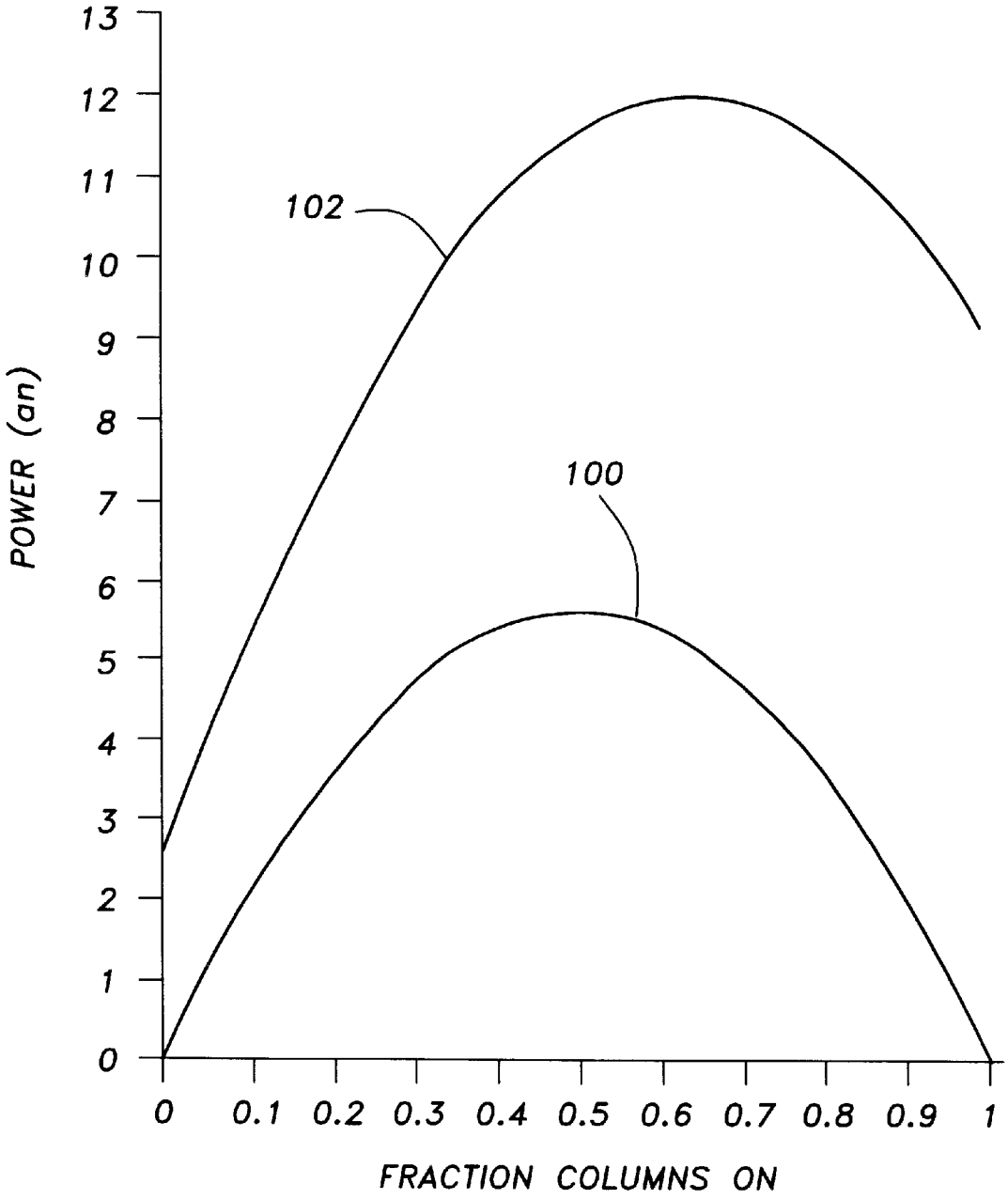
FIG. 4 is a graph showing a relationship of the fraction of columns on to power.

FIG. 1 schematically illustrates a visual display system 20 including a display screen 22, which preferably is an electroluminescent display screen. The display screen 22 is divided into a plurality of pixels 24. The screen pixels 24 are arranged in a matrix of columns and rows. Each pixel is defined by an intersection between a row electrode and a column electrode. Row drivers and column drivers, which are useful for electroluminescent displays, are well known to those skilled in the art. Only a portion of the matrix of screen pixels is schematically illustrated in FIG. 1.

The screen display 22 is coupled, through a conventional wiring arrangement 26, to a controller 28. The controller 28 preferably is a microprocessor. A plurality of control modules are schematically illustrated in FIG. 1. A first module 30 processes data within the controller 28 to determine the content of an image to be displayed on the screen 22. A second module 32 controls the row and column drivers to energize the screen pixels to cause a display to be shown on the screen 22. A third module 34 selectively controls the supply of the energization voltages to the row and column drivers and, therefore, the screen pixels while the display is being shown on the screen 22. A fourth module 36 includes memory for storing information regarding various displays to be shown on the screen 22. Communication between the various modules within the controller 28 is schematically illustrated by the communication lines 38 through 48.

It is important to note that the various modules schematically illustrated in FIG. 1 are for illustration purposes only. The controller 28 need not be divided into distinct modules as shown. Moreover, the functions of each module can be realized, as will be understood by those skilled in the art, through software, discrete circuit components, dedicated circuitry or a combination of the above.

FIG. 2 illustrates the basic method of this invention in flow-chart form. The flow-chart 50 includes a first step 52 where the controller 28 determines the total number of pixels for each brightness level that must be energized on a row-by-row basis to realize a desired image brightness. Then, at 54, a specific order of energizing the pixels is determined that will maximize efficient power usage, reduce drive load variation or both. Once the order is selected, the pixels are accordingly energized at 56.

Frame modulation techniques are well known in the art. For purposes of illustration, FIG. 3 includes a chart 60 that schematically illustrates possible implementations of a preferred method of this invention when using a frame modulation technique. The chart 60 includes a matrix of columns and rows. The first column 62 indicates varying brightness levels for gray shades. The brightness level of a particular screen pixel can vary from dark to high brightness. Each column of the chart 60 (with the exception of the column 62) can be considered as a frame. The image is generated in a sequence of frames through time. Those skilled in the art will realize that pixel energization to accomplish a given brightness level will occur on a row-by-row basis. For simplicity in describing this invention, reference is made to single pixels but actual implementation is on a row-by-row basis.

Consider the first frame or column 63. Each frame is subdivided into three energization periods or energization states 64, 66 and 68, for example. Each energization period corresponds to a time when all of the screen pixels in a particular row are potentially energized or turned on. In the illustrated example, the pixels are energized between zero and three times per frame. For example, a pixel that is to remain dark during the frame 63 is not energized during any one of the energization periods. Accordingly, three zeros are shown in FIG. 3. On the other hand, a pixel that is to have a maximum or high brightness level is energized during each one of the energization periods 64, 66 and 68. That is indicated in FIG. 3 by a series of ones. Accordingly, the ones and zeros in FIG. 3 indicate a pixel being energized or not energized, respectively, during each energization period of each frame.

In case 1 of FIG. 3, three of the four shades of pixels are energized during the first energization period 64. Two of the pixels are energized during the second energization period 66. One pixel, which has a high brightness level, is energized during the third energization period 68.

Only four sample pixels are illustrated in FIG. 3. In a typical display screen 22, however, there may be thousands of pixels arranged in rows. The scenario illustrated as case 1 in FIG. 3 is not necessarily efficiently consuming power. For example, in an embodiment where there are a large number of low and medium brightness leveled pixels, there will be a large load variation between the third energization period of one frame and the first energization period of a subsequent frame. A system designed according to this invention seeks to maximize the efficiency of power consumption by selectively arranging the order in which the pixels are energized during each frame.

The above description applies equally to a system having split column panels. The only difference in the latter system is that two rows are driven simultaneously and, therefore, treated as one row.

Other systems will include multiple color display screens rather than monocolor displays. The strategy of saving power associated with this invention is useful for such systems. The difference introduced by a multiple color display is that each pixel location has a plurality of subpixels to accomplish the different colors. These "color subpixels" typically have varying capacitance due to varying size or dielectric content, for example. The method of this invention is readily implemented in such systems by compensating for the varying capacitances as will be understood by those skilled in the art.

The two main benefits of using a system and method according to this invention are saving power and/or reducing drive load variation when using a frame modulation technique to effect varying brightness levels on a display screen.

This invention incorporates the realization of a predictable relationship between modulation power and the percentage of screen pixels that are energized at any given time. An equation describes this relationship, which is $$P_M(x)=-4x^2+4x \qquad \text{(equation 1).}$$

A sample plot of this curve is shown at 100 in FIG. 4 where the fraction of energized columns is plotted versus amount of power (in arbitrarily scaled power units). $P_M(x)$ is the relative modulation power and x is the fraction of screen pixels that are energized at a given time. Equation 1 also quantifies the relative capacitive load on the column driving matrix used to power the display screen because the drive power is proportional to the capacitance. The row drivers of the display screen 22 effectively experience an impedance. Accordingly, a more accurate equation for describing total panel-driving power consumption is as follows:

$$P_T(m)=JmC_{off}(Vr+Vc)^2f+(M-m)C_{off}(Vr)^2f+kC_{off}(Mm-m^2)(Vc)^2f \qquad \text{(equation 2)}$$

Where there are N rows and M columns, k=(N−1)/M,

J=Con/Coff (typically approximately 2.2), m=the number of energized pixels at a given time, Con=the on pixel capacitance, Coff=The off pixel capacitance, Vr=equals the row voltage, Vc=the column or modulation voltage and f=the horizontal or line frequency.

The final portion of equation 2 is the modulation power term. As one skilled in the art will appreciate, the shape of the curve of equation 2 varies with panel size and aspect ratio. Importantly, the total power curve is not symmetrical about a point corresponding to fifty percent of the pixels being energized. An example total power curve is shown at 102 in FIG. 4. Efficient power consumption appears to be achieved primarily by having less than fifty percent of all screen pixels energized at any given time.

Figure 5:
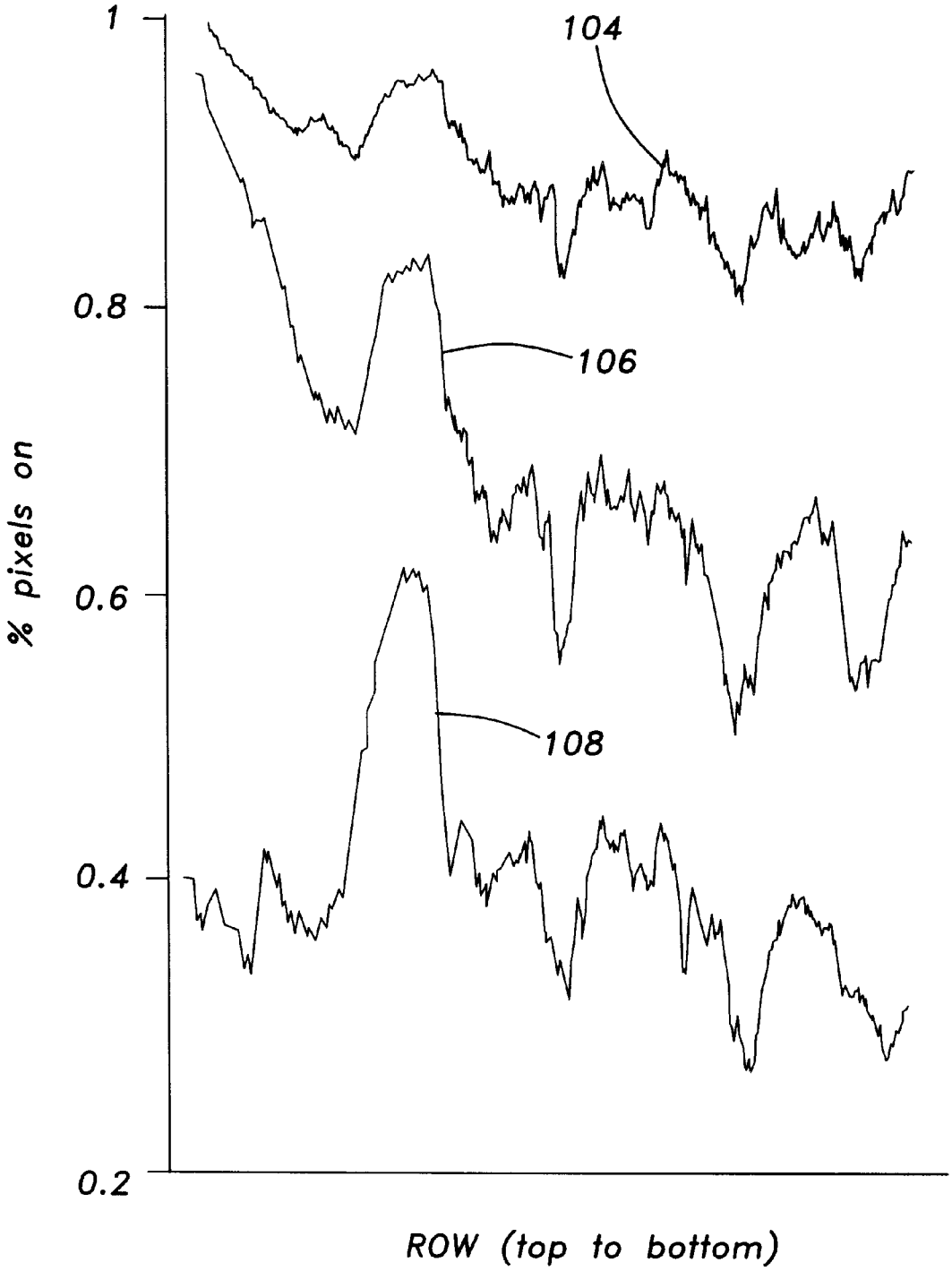
FIG. 5 illustrates an example realization of an image where the energization strategy includes case 1 of FIG. 3.
Figure 6:
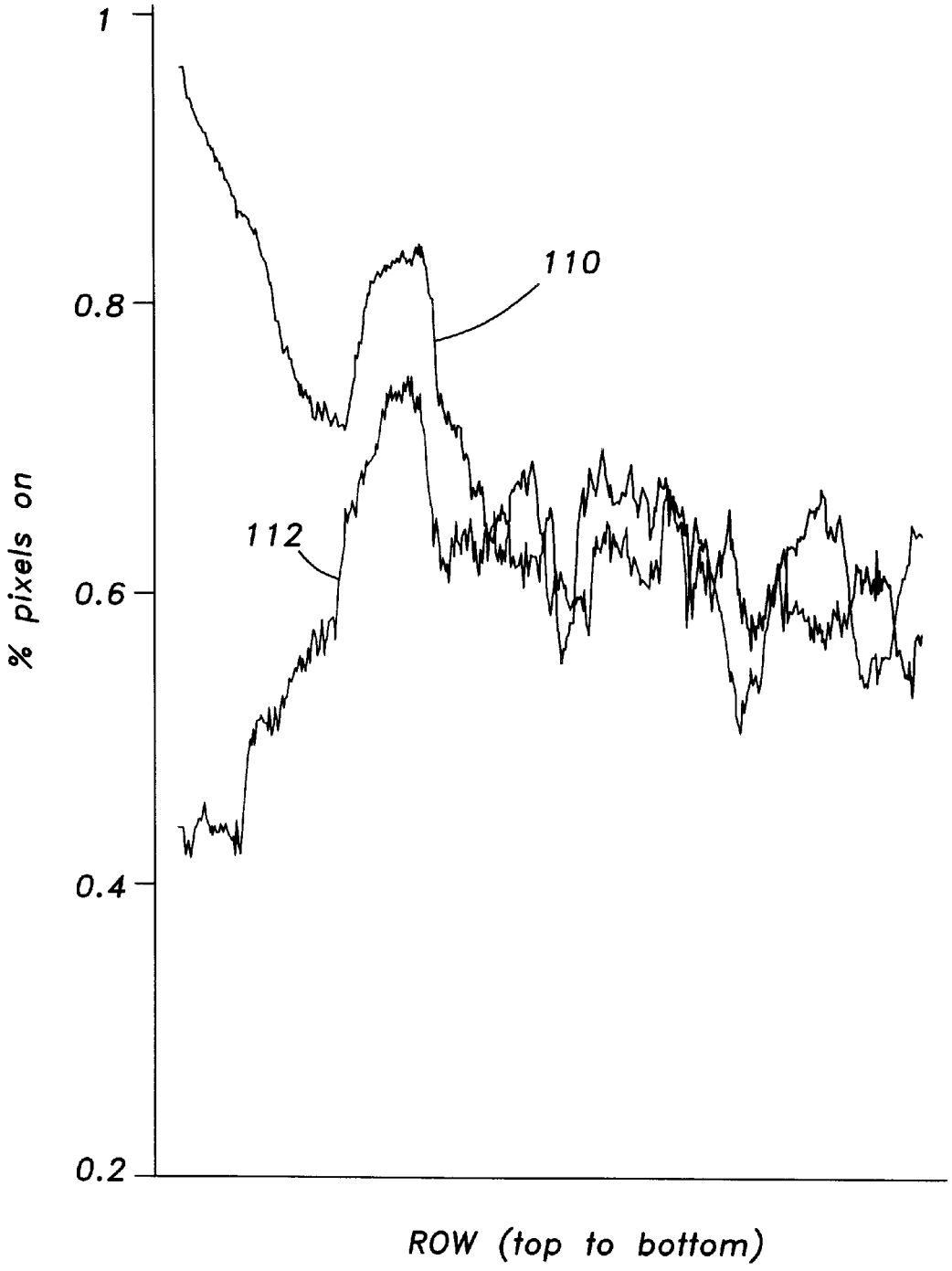
FIG. 6 illustrates an example realization of an image where the energization strategy includes case 3 of FIG. 3.

FIGS. 5 and 6 graphically illustrate the percentage of pixels turned on or energized within each row. The illustration in FIG. 5 shows an example realization of an image where the energization strategy includes case 1 from FIG. 3. The plot 104 corresponds to the energization state 64 while the plots 106 and 108 correspond to the energization states 66 and 68, respectively.

The same image is generated using frame 86 (i.e. Case 3) from FIG. 3 and the resulting curve is shown in FIG. 6. The first and second energization periods have the plot 110 while the third energization period results in the curve 112. Those skilled in the art will realize that the illustrations in FIGS. 5 and 6 are for explanation purposes only. Different energization strategies preferably are applied to each row.

Considering case 4 in column 70 of FIG. 3, the same brightness levels are achieved as were achieved in case 1 in column 63. The order of energization of the pixels, however, has been rearranged. Specifically, the first energization state 72 includes three pixels being energized, the second energization state 74 includes one pixel being energized and the third energization state 76 includes two pixels being energized. Such a strategy for energizing the pixels may not necessarily provide a reduction in power consumption compared to the scenario in column 63, however, it may accomplish that result in combination with another one of the cases illustrated in FIG. 3.

For example, consider an embodiment where the arrangement of pixel energization includes having one frame 70 followed by a second frame 78 that is, in turn, followed by a frame 70, etc. In this example, the order of pixel energization follows energization states 72, 74, 76, 80, 82 and 84. The energization state 84 is then followed by the energization state 72 and this process is cyclically repeated as required for generating the display on the screen 22.

Assume further that this embodiment includes a symmetric drive scheme. The symmetric drive scheme includes alternating a voltage polarity associated with the row drivers between a negative and positive polarity, respectively. The voltage polarity is alternated on an energization period-by-energization period basis, in this example. In some systems a negative polarity voltage has a lower magnitude than a positive polarity voltage by an amount equal to the magnitude of the column-writing voltage. Under these circumstances, it is useful to arrange the pixel energization in an order of case 4 (i.e., column 70) followed by case 8 (i.e., column 78) in a cyclical pattern.

The reason for the advantage is that a greater number of pixels are energized or turned on each time that a voltage having a negative polarity is generated. Specifically, assuming that the first energization state 72 includes a voltage having a negative polarity, three pixels are energized during that energization period. Two pixels are energized during the energization period 76 and three pixels are energized during the energization period 82, respectively. The energization periods 74, 80 and 84 all have a voltage associated with them that has a positive polarity. Accordingly, it is advantageous to have fewer pixels energized during those energization periods.

In other systems it will be more advantageous to have a greater number of pixels energized each time that a voltage having a positive polarity is generated. Accordingly different cases from FIG. 3 may be utilized.

Turning now to case 3, which is illustrated in column 86, the order of pixel energization is arranged such that two pixels are energized during each energization period. Having an equal number of energized pixels during each energization period ensures that one-half of the pixels are energized at all times. In this example, there is the advantage of having no variation in the load or the amount of power used to drive the load. The modulation power in this example, however, is at its theoretical maximum.

Accordingly, those skilled in the art will appreciate that various combinations of the different cases illustrated in FIG. 3 can be used to develop a specific order of pixel energization to maximize power consumption and/or reduce the amount of drive load variation when powering a display screen 22. Measuring the total power consumed when utilizing various combinations of selectively energized pixels provides the ability to develop an ideal sequence of pixel energization for any given combination. In general, a system designed according to this invention arranges the order of pixel energization such that preferred ratios of on and off pixels during any of the energization states are kept within a preselected range. Alternatively, the system ensures that a difference between the number of energized pixels in any two energization states does not exceed a preselected maximum. All of these functions are accomplished by the controller 28.

Given the above description, one skilled in the art can develop specific code to program the controller 28 for implementing the techniques of this invention. Similarly, one skilled in the art will now be able to choose from among commercially available microprocessors or to develop dedicated circuitry that will serve as the controller 28.

The foregoing description is exemplary rather than limiting in nature. Variations and modifications to the disclosed embodiment will become apparent to those skilled in the art that do not necessarily depart from the purview and spirit of this invention. For example, four level shading has been discussed but any number of shading levels can be accommodated according to this invention. Accordingly, the legal scope of protection afforded to this invention can be determined only by studying the following claims.

What is claimed is:

1. A method of controlling power consumption while controlling the brightness of a display screen that displays an electrically generated image over a plurality of screen pixels, comprising the steps of:

(A) determining a total number of screen pixels that must be energized to display the image;

(B) determining an order of energization of selected ones of the screen pixels, based upon the total number determined in step (A), the determined order having a more efficient power usage in energizing the total number of screen pixels as compared with other orders of energization of the selected ones of the screen pixels; and (C) selectively energizing the total number of screen pixels in the order determined in step (B) to thereby control the power consumption.

2. The method of claim 1, further comprising displaying the image in a sequence of frames and wherein steps (A) through (C) are performed for each frame.

3. The method of claim 2, further comprising dividing each frame into a plurality of energization periods and wherein step (B) is performed by arranging the total number of pixels among the energization periods such that a number of energized pixels within each energization period does not exceed a preselected maximum.

4. The method of claim 3, wherein the preselected maximum is determined using the total number from step (A) and a total number of energization periods.

5. The method of claim 3, wherein the preselected maximum is less than one-half of a sum total of the entire plurality of pixels on the display screen.

6. The method of claim 3, wherein step (B) is performed by the further substep of proportionally arranging the energized pixels among the plurality of energization periods such that a difference between a number of energized pixels within any two energization periods is within a preselected range.

7. The method of claim 1, wherein step (A) is performed by determining a brightness level to be displayed on the display at each pixel on the screen for the image, wherein a brightness level is one of a plurality of levels in a range from dark to full brightness.

8. The method of claim 7, wherein step (A) is performed by determining the total number as a number of screen pixels that will have a brightness level above dark in the image.

9. The method of claim 7, further comprising generating the display in a plurality of frames that are each subdivided into a plurality of energization states and wherein step (B) is performed by assigning selected ones of the total number of pixels to each energization state such that a difference between a number of energized pixels within any two energization periods is within a preselected range.

10. The method of claim 9, wherein steps (A) through (C) are performed for each frame.

11. The method of claim 1, wherein step (C) is performed by generating an energization voltage to energize each pixel and varying the energization voltage in a preselected pattern and further comprising determining desired total energization conditions, using the total number of pixels to be energized and the preselected pattern.

12. The method of claim 11, wherein step (C) is performed by sequentially alternating the energization voltage between a first voltage having a first polarity and a second voltage having a second polarity and wherein step (B) is performed by arranging the order of energization to correspond to having a first number of pixels energized when the first voltage is generated and a second number of pixels energized when the second voltage is generated.

13. The method of claim 1, wherein the determined order maximizes the efficient power usage.

14. A system for controlling power consumption while controlling the brightness levels in an electrically generated image, comprising:

a display screen for displaying the image and having a plurality of screen pixels arranged in a preselected pattern across an entirety of said screen; and a controller having a plurality of modules including:

a first module that determines the content of the image to be displayed on said screen wherein said content includes data indicating levels of brightness within the image, a second module that generates an energization voltage for energizing said screen pixels, said energization voltage being generated in a preselected repeated pattern of cycles, and a third module that selectively directs said energization voltage to selected ones of said pixels during each said cycle responsive to said data indicating levels of brightness and wherein said third module determines a total number of screen pixels that must be energized to realize said levels of brightness and apportions said energization voltage among selected ones of said total number of pixels during each said cycle dependent on the determined total number of said screen pixels to thereby control power consumption to efficiently use energy supplied to said system.

15. The system of claim 14, wherein said preselected repeated pattern includes alternating first and second cycles, said second module alternates said energization voltage between a first voltage having a first polarity during said first cycle and a second voltage having a second polarity during said second cycle and wherein said third module apportions selected ones of said total number of energized pixels among said first and second cycles such that a ratio of a number of energized pixels during each occurrence of said first cycle to a number of energized pixels during each occurrence of said second cycle is within a preselected range.

16. The system of claim 15, wherein a first number of energized pixels during said first cycle is less than a second number of energized pixels during said second cycle.

17. A method of controlling power consumption while controlling the brightness of a display screen that displays an electrically generated image over a plurality of screen pixels, comprising the steps of:

(A) determining a total number of screen pixels that must be energized to display the image;

(B) determining an order of energization of selected ones of the screen pixels, based upon the total number determined in step (A) by arranging the order of energization to correspond to having a first number of pixels energized during a first cycle and a second number of pixels energized during a second cycle, wherein the second number of energized pixels is greater than the first number of energized pixels; and (C) selectively energizing the total number of screen pixels in the order determined in step (B) by generating an energization voltage to energize each pixel and varying the energization voltage in a preselected pattern that includes sequentially alternating the energization voltage between a first voltage having a positive polarity during the first cycle and a second voltage having a negative polarity during the second cycle.

18. The method of claim 17, further comprising determining desired total energization conditions, using the total number of pixels to be energized and the preselected pattern.

19. A method of controlling power consumption while controlling the brightness of a display screen that displays an electrically generated image over a plurality of screen pixels, comprising the steps of:

(A) determining a total number of screen pixels that must be energized to display the image;

(B) determining an order of energization of selected ones of the screen pixels, based upon the total number determined in step (A), the determined order having a reduced drive load variation in energizing the total number of screen pixels as compared with other orders of energization of the selected ones of the screen pixels; and (C) selectively energizing the total number of screen pixels in the order determined in step (B) to thereby control the power consumption.

* * * * *